United States Patent [19]

Avidan et al.

[11] Patent Number: 4,822,477

[45] Date of Patent: Apr. 18, 1989

[54] INTEGRATED PROCESS FOR GASOLINE PRODUCTION

[75] Inventors: Amos A. Avidan, Mantua; Tai-Sheng Chou, Sewell, both of N.J.

[73] Assignee: Mobil Oil Corporation, New York, N.Y.

[21] Appl. No.: 220,358

[22] Filed: Jul. 15, 1988

Related U.S. Application Data

[63] Continuation of Ser. No. 60,541, Jun. 11, 1987, abandoned.

[51] Int. Cl.[4] ..... C10G 63/04

[52] U.S. Cl. ..... 208/70; 208/49; 208/113; 208/155; 208/164; 585/322; 585/407; 585/431; 585/533

[58] Field of Search ..... 208/70, 71, 164, 155, 208/49, 74, 113; 585/322, 330, 407, 533

[56] References Cited

U.S. PATENT DOCUMENTS

| | | | |
|---|---|---|---|
| 3,856,659 | 12/1974 | Owen | 208/155 |
| 3,891,540 | 6/1975 | Demmel et al. | 208/77 |
| 3,894,931 | 7/1975 | Nace et al. | 208/74 |
| 3,894,935 | 7/1975 | Owen | 208/74 |
| 3,907,663 | 9/1975 | Owen | 208/70 |
| 3,974,062 | 8/1976 | Owen et al. | 288/164 |
| 4,560,536 | 12/1985 | Tabak | 208/70 |
| 4,560,537 | 12/1985 | Tabak | 208/49 |
| 4,606,810 | 8/1986 | Krambeck et al. | 208/155 |
| 4,675,461 | 6/1987 | Owen et al. | 585/330 |

*Primary Examiner*—Anthony McFarlane
*Attorney, Agent, or Firm*—Alexander J. McKillop; Michael G. Gilman; L. G. Wise

[57] ABSTRACT

An improvement in gasoline octane without substantial decrease in overall yield is obtained in an integrated process combining a fluidized catalytic cracking reaction and a fluidized catalyst olefin oligomerization reaction when crystalline medium pore shape selective zeolite catalyst particles are withdrawn in partially deactivated form from the oligomerization reaction stage and added as part of the active catalyst in the FCC reaction.

12 Claims, 3 Drawing Sheets

INTEGRATED PROCESS FOR GASOLINE PRODUCTION

This is a continuation of copending application Ser. No. 060,541, filed on June 11, 1987, now abandoned.

BACKGROUND OF THE INVENTION

This invention relates to a catalytic technique for cracking heavy petroleum stocks and upgrading light olefin gas to heavier hydrocarbons. In particular, it provides a continuous integrated process for oligomerizing olefinic light gas byproduct of cracking to produce $C_5$+hydrocarbons, such as olefinic liquid fuels, aromatics and other useful products. Ethene, propene and/or butene containing gases, such as petroleum cracking light gas from a fluidized catalytic cracking unit may be upgraded by contact with a crystalline medium pore siliceous zeolite catalyst.

Developments in zeolite catalysis and hydrocarbon conversion processes have created interest in utilizing olefinic feedstocks for producing $C_5$+ gasoline, diesel fuel, etc. In addition to basic chemical reactions promoted by zeolite catalysts having a ZSM-5 structure, a number of discoveries have contributed to the development of new industrial processes. These are safe, environmentally acceptable processes for utilizing feedstocks that contain lower olefins, especially $C_2$–$C_4$ alkenes. Conversion of $C_2$–$C_4$ alkenes and alkanes to produce aromatics-rich liquid hydrocarbon products were found by Cattanach (U.S. Pat. No. 3,760,024) and Yan et al (U.S. Pat. No. 3,845,150) to be effective processes using the zeolite catalysts having a ZSM-5 structure. U.S. Pat. Nos. 3,960,978 and 4,021,502 (Plank, Rosinski and Givens) disclose conversion of $C_2$–$C_5$ olefins, alone or in admixture with paraffinic components, into higher hydrocarbons over crystalline zeolites having controlled acidity. Garwood et al. have also contributed to the understanding of catalytic olefin upgrading techniques and improved processes as in U.S. Pat. Nos. 4,150,062, 4,211,640 and 4,227,992. The above-identified disclosures are incorporated herein by reference.

Conversion of lower olefins, especially propene and butenes, over HZSM-5 is effective at moderately elevated temperatures and pressures. The conversion products are sought as liquid fuels, especially the $C_5$+ aliphatic and aromatic hydrocarbons. Product distribution for liquid hydrocarbons can be varied by controlling process conditions, such as temperature, pressure, catalyst activity and space velocity. Gasoline ($C_5$–$C_{10}$) is readily formed at elevated temperature (e.g., up to about 400° C.) and moderate pressure from ambient to about 5500 kPa, preferably about 250 to 2900 kPa. Olefinic gasoline can be produced in good yield and may be recovered as a product or fed to a low severity, high pressure reactor system for further conversion to heavier distillate-range products.

Recently it has been found that olefinic light gas can be upgraded to liquid hydrocarbons rich in olefins or aromatics by catalytic conversion in a turbulent fluidized bed of solid medium pore acid zeolite catalyst under effective reaction severity conditions. Such a fluidized bed operation typically requires oxidative regeneration of coked catalyst to restore zeolite acidity for further use, while withdrawing spent catalyst and adding fresh acid zeolite to maintain the desired average catalyst activity in the bed. This technique is particularly useful for upgrading FCC light gas, which usually contains significant amounts of ethene, propene, $C_1$–$C_4$ paraffins and hydrogen produced in cracking heavy petroleum oils or the like.

Economic benefits and increased product quality can be achieved by integrating the FCC and oligomerization units in a novel manner. It is a main object of the present invention to further extend the usefulness of the medium pore acid zeolite catalyst used in the olefinic light gas upgrading reaction by withdrawing a portion of partially deactivated and coked zeolite catalyst and admixing the withdrawn portion with cracking catalyst in a primary FCC reactor stage. Prior efforts to increase the octane rating of FCC gasoline by addition of zeolites having a ZSM-5 structure to large pore cracking catalysts have resulted in a small decrease in gasoline yield and increased light olefin by product.

SUMMARY OF THE INVENTION

It has been discovered that overall gasoline octane rating can be increased with little or no loss in net gasoline yield in an integrated fluidized catalytic cracking (FCC)-olefins oligomerization process when partially deactivated catalyst is transferred from an olefins oligomerization unit to a continuously operated FCC riser reactor stage. The partially deactivated catalyst, preferably a solid medium pore siliceous acidic zeolite catalyst which is compatible with the FCC catalyst inventory, can be mixed with the regenerated FCC catalyst prior to addition to the cracking zone or simply added directly to the fluidized bed of cracking catalyst.

The present process allows for an extended use of the zeolite oligomerization catalyst which would otherwise be unsuitable for further use in the olefin upgrading unit due to insufficient acidity. The partially spent zeolite catalyst from the olefins oligomerization unit, with or without coke, is an excellent gasoline octane booster for an FCC unit because of increased alkylate production. When partially deactivated zeolite catalyst is added to the standard FCC catalyst inventory in minor amounts, the integrated FCC-olefins oligomerization process is optimized to produce high octane $C_5$+ gasoline.

DESCRIPTION OF THE INVENTION

Figure 1:
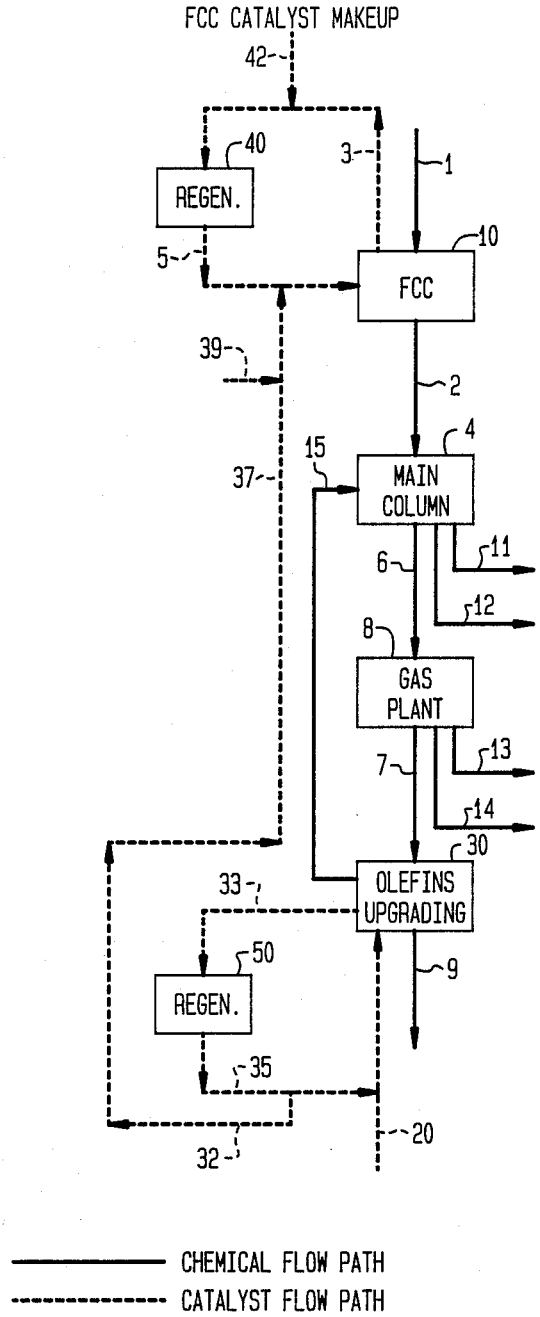
FIG. 1 is a schematic representation of an integrated system and process depicting a primary stage fluidized catalytic cracking zone and a secondary stage olefins oligomerization zone. The flow of chemicals is designated by solid lines and the flow of catalyst is designated by broken lines.

In this description, metric units and parts by weight are employed unless otherwise stated.

The present invention provides a continuous multistage process for producing liquid hydrocarbons from a relatively heavy hydrocarbon feedstock. This technique comprises contacting the feedstock in a primary fluidized bed reaction stage with a mixed catalyst system which comprises finely divided particles of a first large pore cracking catalyst component and similar size particles of a second medium pore siliceous zeolite catalyst component under cracking conditions to obtain a product comprising cracked hydrocarbons including intermediate gasoline, distillate range hydrocarbons, and lower olefins. The lower olefins are separated from the heavier products and contacted in a secondary fluidized bed reaction stage with medium pore siliceous zeolite catalyst under reaction severity conditions effective to upgrade at least a portion of the lower molecular weight olefins to $C_5$+ hydrocarbons. This results in depositing carbonaceous material onto the solid catalyst, which may be oxidatively regenerated in a second stage regenerator for further use. While much of the activity loss due to coking can be regained by oxidative regeneration, repeated use results in a long term, permanent deactivation, thus requiring replenishment of the fresh catalyst to maintain the desired level of average catalyst activity in the fluidized bed reactor.

The present process can be practiced by withdrawing a portion of partially deactivated or equilibrium catalyst particles from the secondary reactor; passing the particles to a second stage oxidative regeneration zone for preparing reactivated equilibrium catalyst particles; adding a small portion of the reactivated particles to the primary catalytic cracking reactor; and recycling a large portion of reactivated catalyst particles to the secondary reactor. The catalyst makeup of a primary stage FCC unit and a secondary stage olefins conversion unit can thus be balanced.

FLUIDIZED CATALYTIC CRACKING-(FCC) REACTOR OPERATION

In conventional fluidized catalytic cracking processes, a relatively heavy hydrocarbon feedstock, e.g., a gas oil, is admixed with hot cracking catalyst, e.g., a large pore crystalline zeolite such as zeolite Y, to form fluidized suspension. A fast transport bed reaction zone produces cracking in an elongated riser reactor at elevated temperature to provide a mixture of lighter hydrocarbon crackate products. The gasiform reaction products and spent catalyst are discharged from the riser into a solids separator, e.g., a cyclone unit, located within the upper section of an enclosed catalyst stripping vessel, or stripper, with the reaction products being conveyed to a product recovery zone and the spent catalyst entering a dense bed catalyst regeneration zone within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized cracking catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers), incorporated herein by reference.

Several of these processes employ a mixture of catalysts having different catalytic properties as, for example, the catalytic cracking process described in U.S. Pat. No. 3,894,934 which utilizes a mixture of a large pore crystalline zeolite cracking catalyst such as zeolite Y and shape selective medium pore crystalline metallosilicate zeolite such as ZSM-5. Each catalyst contributes to the function of the other to produce a gasoline product of relatively high octane rating.

A fluidized catalytic cracking process in which a cracking catalyst such as zeolite Y is employed in combination with a shape selective medium pore crystalline siliceous zeolite catalyst such as ZSM-5, permits the refiner to take greater advantage of the unique catalytic capabilities of ZSM-5 in a catalytic cracking operation such as increasing octane rating.

The major conventional cracking catalysts presently in use generally comprise a large pore crystalline zeolite, generally in a suitable matrix component which may or may not itself possess catalytic activity. These zeolites typically possess an average cyrstallographic pore dimension greater than 8.0 Angstroms for their major pore opening. Representative crystalline zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synthetic mordenite, dealuminized synthetic mordenite, merely to name a few, as well as naturally occurring zeolites such as chabazite, faujasite, mordenite, and the like. Also useful are the silicon-substituted zeolites described in U.S. Pat. No. 4,503,023.

It is, of course, within the scope of this invention to employ two or more of the foregoing large pore crystalline cracking catalysts. Preferred large pore crystalline zeolite components of the mixed catalyst composition herein include the synthetic faujasite zeolites X and Y with particular preference being accorded zeolites Y, REY, USY and RE-USY.

The shape selective medium pore crystalline zeolite catalyst can be present in the mixed catalyst system over widely varying levels. For example, the zeolite of the second catalyst component can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

The catalytic cracking unit is preferably operated under fluidized flow conditions at a temperature within the range of from about 480° C. to about 735° C., a first catalyst component to charge stock ratio of from about 2:1 to about 15:1 and a first catalyst component contact time of from about 0.5 to about 30 seconds. Suitable charge stocks for cracking comprise the hydrocarbons generally and, in particular, petroleum fractions having an initial boiling point range of at least 205° C., a 50% point range of at least 260° C. and an end point range of at least 315° C. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking. The boiling temperatures utilized herein are expressed in terms of convenience of the boiling point corrected to atmospheric pressure.

OLEFINS OLIGOMERIZATION REACTOR OPERATION

A typical olefins oligomerization reactor unit employs a temperature-controlled catalyst zone with indirect heat exchange and/or fluid gas quench, whereby the reaction exotherm can be carefully controlled to prevent excessive temperature above the usual operating range of about 315° C. to 510° C., preferably at average reactor temperature of 315° C. to 430° C. The alkene conversion reactors operate at moderate pressure of about 100 to 3000 kPa, preferably 300 to 2000 kPa.

The weight hourly space velocity (WHSV), based on total olefins in the fresh feedstock is about 0.1–5 WHSV. Typical product fractionation systems are described in U.S. Pat. Nos. 4,456,779 and 4,504,693 (Owen, et al.).

The use of a fluid-bed reactor in this process offers several advantages over a fixed-bed reactor. Due to continuous catalyst regeneration, fluid-bed reactor operation will not be adversely affected by oxygenate, sulfur and/or nitrogen containing contaminants present in FCC fuel gas. In addition, high isobutane yield from a fluid bed reactor operation can be a significant advantage in isobutane short refineries.

The reaction temperature can be controlled by adjusting the feed temperature so that the enthalpy change balances the heat of reaction. The feed temperature can be adjusted by a feed preheater, heat exchange between the feed and the product, or a combination of both. Once the feed and product compositions are determined using, for example, an on-line gas chromatograph, the feed temperature needed to maintain the desired reactor temperature, and consequent olefin conversion, can be easily predetermined from a heat balance of the system. In a commercial unit this can be done automatically by state-of-the-art control techniques.

A typical light gas feedstock to the olefins oligomerization reactor contains $C_2$–$C_6$ alkenes (mono-olefin), usually including at least 2 mole % ethane, wherein the total $C_2$–$C_3$ alkenes are in the range of about 10 to 40 wt%. Non-deleterious components, such as hydrogen, methane and other paraffins and inert gases, may be present. Some of the paraffins in the feed will also convert to $C_4$+ hydrocarbons, depending on reaction conditions and the catalyst employed. The preferred feedstock is a light gas by-product of FCC gas oil cracking units containing typically 10–40 mol % $C_2$–$C_4$ olefins and 5–35 mol % $H_2$ with varying amounts of $C_1$–$C_3$ paraffins and inert gas, such as $N_2$. The process may be tolerant of a wide range of lower alkanes, from 0 to 95%. Preferred feedstocks contain more than 50 wt. % $C_1$–$C_4$ lower aliphatic hydrocarbons, and contain sufficient olefins to provide total olefinic partial pressure of at least 50 kPa. Under high severity reaction conditions, which can be employed in the present invention, lower alkanes (e.g., propane) may be partially converted to $C_4$+ products.

The desired products are $C_4$ to $C_9$ hydrocarbons, which will comprise at least 50 wt.% of the recovered product, preferably 80% or more. While olefins may be a predominant fraction of the $C_4$+ reaction effluent, up to 45% butenes, pentenes, hexenes, heptenes, octenes, nonenes and their isomers; it is desired to upgrade the feedstock to high octane gasoline containing aromatics, preferably at least 10% by weight.

The reaction severity conditions can be controlled to optimize yield of $C_4$–$C_9$ aliphatic hydrocarbons. It is understood that aromatics and light paraffin production is promoted by those zeolite catalysts having a high concentration of Bronsted acid reaction sites. Accordingly, an important criterion is selecting and maintaining catalyst inventory to provide either fresh catalyst having acid activity or by controlling catalyst deactivation and regeneration rates to provide an apparent average alpha value of about 15 to 80.

Reaction temperatures and contact time are also significant factors in the reaction severity, and the process parameters are followed to give a substantially steady state condition wherein the reaction severity index (R.I.) is maintained within the limits which yield a desired weight ratio of propane to propene. While this index may vary from about 0.1 to 200, it is preferred to operate the steady state fluidized bed unit to hold the R.I. at about 0.2:1 to 5:1, especially in the absence of added propane. While reaction severity is advantageously determined by the weight ratio of propane:propene in the gaseous phase, it may also be approximated by the analogous ratios of butanes:butenes, pentanes:pentenes, or the average of total reactor effluent alkanes:alkenes in the $C_3$–$C_5$ range. Accordingly, these alternative expressions may be a more accurate measure of reaction severity conditions when propane is added to the feedstock. Typical ethene-rich light gas mixtures used in cracking process off-gas can be upgraded to the desired aliphatic-rich gasoline by keeping the R.I. at an optimum value of about 1 in the absence of added propane.

The olefinic feedstream may be enriched by addition of propane to increase the production of $C_4$+ product. Propane containing streams, such as $C_3$–$C_4$ LPG and various refinery fractions can be employed to supplement the olefinic feedstock. Suitable $C_2$–$C_4$ aliphatic mixtures containing 20 to 85 wt.% propane may enhance olefinic feedstocks of 15 to 79% mono-alkene. Since propane conversion is incomplete under ordinary operating conditions, this addition can raise the apparent $C_3$ R.I. value above 50:1.

In the continuous operation of the oligomerization stage, fresh catalyst having a relatively high alpha value is contacted with olefinic feedstock in a reaction zone under reaction conditions to obtain a hydrocarbon product. A small amount of catalyst can be periodically withdrawn from the reaction zone, said catalyst having up to about 3% coke deposited thereupon, and regenerated in an oxidative regeneration zone. The regenerated catalyst is then returned to the reaction zone. Transport of the catalyst from the reaction zone to the regeneration zone and back to said reaction zone is repeated during the continuous operation of the oligomerization stage. When the oligomerization stage is operated in a continuous manner over a period of time, the catalyst within the reactor begins to lose activity and oxidative regeneration restores only a portion of that activity. Once the alpha value of the catalyst reaches a lower limit, beyond which oligomerization reactions proceed slowly, the steady state of the process can be maintained by withdrawing a small amount of catalyst, eg. 1%/day, from the oligomerization stage inventory and adding a similar small amount of fresh catalyst to replenish second stage catalyst inventory. In a preferred embodiment, "spent equilibrium catalyst is withdrawn from the oxidative regeneration zone, and the fresh catalyst is added directly to the reaction zone. By this procedure, the average alpha value of the catalyst in the oligomerization stage is maintained at a desirable level, preserving the steady state of the oligomerization process.

The procedure of withdrawing catalyst and adding a similar amount of fresh catalyst can be performed either continuously or at periodic intervals throughout the operating of the oligomerization stage.

The composition of the withdrawn catalyst is heterogeneous. The withdrawn catalyst, called partially deactivated or equilibrium catalyst, comprises fresh catalyst particles having a high alpha value, permanently deactivated catalyst particles having a low alpha value, and catalyst particles at various stages of deactivation having alpha values in the range between fresh and permanently deactived catalyst particles. Although each of the particles in any sample of equilibrium catalyst has its own alpha value, the entire sample has an "average" alpha value. In the present process, equilibrium catalyst has an average alpha value of at least about 2.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds.

Developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolitic framework. These medium pore zeolites are favored for acid catalysis; however, the advantages of ZSM-5 structures may be utilized by employing highly siliceous materials or cystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The metallosilicate catalysts useful in the process of this invention may contain a siliceous zeolite generally known as a shape-selective ZSM-5 type. The members of the class of zeolites useful for such catalysts have an effective pore size of generally from about 5 to about 7 Angstroms such as to freely sorb normal hexane. In addition, the structure provides constrained access to larger molecules. A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of smaller size, e.g. less than 7 Angstroms. Large pore zeolites which provide relatively free access to the internal zeolite structure have a low value for the Constraint Index, and usually have pores of large size, e.g. greater than 8 Angstroms. The method by which Constraint Index is determined is described fully in U.S. Pat. No. 4,016,218, (Haag et al) incorporated herein by reference for details of the method.

The class of siliceous medium pore zeolites defined herein is exemplified by ZSM-5, ZSM-11, ZSM-12, ZSM-22, ZSM-23, ZSM-35, ZSM-48, and other similar materials. ZSM-5 is described in U.S. Pat. No. 3,702,886 (Argauer et al); ZSM-11 in U.S. Pat. No. 3,709,979 (Chu); ZSM-12 in U.S. Pat. No. 3,832,449 (Rosinski et al); ZSM-22 in U.S. Pat. No. 4,046, 859 (Plank et al); ZSM-23 in U.S. Pat. No. 4,076,842 (Plank et al); ZSM-35 in U.S. Pat. No. 4,016,245 (Plank et al); and ZSM-48 in U.S. Pat. No. 4,397,827 (Chu). The disclosures of these patents are incorporated herein by reference. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt.% silica and/or alumina binder.

These siliceous zeolites may be employed in their acid forms ion exchanged or impregnated with one or more suitable metals, such as Ga, Pd, Zn, Ni Co and/or other metals of Periodic Groups III to VIII. The zeolite may include a hydrogenation-dehydrogenation component (sometimes referred to as a hydrogenation component) which is generally one or more metals of group IB, IIB, IIIB, VA, VIA or VIIIA of the Periodic Table (IUPAC), especially aromatization metals, such as Ga, Pd, etc. Useful hydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc. The catalyst materials may include two or more catalytic components, such as a metallic oligomerizaton component (eg, ionic $Ni^{+2}$, and a shape-selective medium pore acidic oligomerization catalyst, such as ZSM-5 zeolite) which components may be present in admixture or combined in a unitary bifunctional solid particle. It is possible to utilize an ethene dimerization metal or oligomerization agent to effectively convert feedstock ethene in a continuous reaction zone.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5 having a silica:aluminum molar ratio of 25:1 to 70:1 with an apparent alpha value of 10–80 to convert 60 to 100 percent, preferably at least 70%, of the olefins in the feedstock.

Pentasil zeolites having a ZSM-5 structure are particularly useful in the process because of their regenerability, long life and stability under the extreme conditions of operation. Usually the zeolite crystals have a crystal size from about 0.01 to cover 2 microns or more, with 0.02–1 micron being preferred. In order to obtain the desired particle size for fluidization in the turbulent regime, the zeolite catalyst crystals are bound with a suitable inorganic oxide, such as silica, alumina, clay, etc. to provide a zeolite concentration of about 5 to 95 wt.%. In the description of preferred embodiments a 25% H-ZSM-5 catalyst contained within a silica-alumina matrix and having a fresh alpha value of about 80 is employed unless otherwise stated.

THE INTEGRATED SYSTEM

The continuous multi-stage process disclosed herein successfully integrates a primary stage Fluidized Catalytic Cracking operation and a secondary stage olefins oligomerization reaction to obtain a substantial increase in octane number with not more than minimal loss in overall yield of liquid hydrocarbons. When the oligomerization reaction is conducted at high severity reaction conditions, a major proportion of by-product ethene from the FCC operation is converted to valuable hydrocarbons. The integrated process comprises contacting crackable petroleum feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_6$ olefins, intermediate hydrocarbons in the gasoline and distillate range, and cracked bottoms; separating the gas containing $C_2$–$C_6$ olefins; reacting at least a portion of the light gas in a secondary fluidized bed reactor stage in contact with medium pore acid zeolite catalyst particles under reaction conditions to effectively convert a portion of the $C_2$–$C_6$ olefins to hydrocarbons boiling in the gasoline or distillate range; withdrawing a portion of catalyst from the secondary fluidized bed reaction stage; and passing the withdrawn catalyst portion to the primary fluidized bed reaction stage for contact with the petroleum feedstock.

In a most preferred embodiment, the process comprises: maintaining a primary fluidized bed reaction stage containing cracking catalyst comprising a mixture of crystalline aluminosilicate particles having a pore size greater than 8 Angstroms and crystalline medium pore zeolite particles having a pore size of about 5 to 7 Angstroms; converting a feedstock comprising a heavy petroleum fraction boiling above about 250° C. by passing the feedstock upwardly through the primary stage fluidized bed in contact with the mixture of cracking catalyst particles under cracking conditions of temperature and pressure to obtain a product stream comprising cracked hydrocarbons; separating the product stream to produce olefinic gas, intermediate products containing $C_3$–$C_4$ olefins, gasoline and distillate range hydrocarbons, and a bottoms fraction; maintaining a secondary fluidized bed reaction stage containing olefins conversion catalyst comprising crystalline medium pore acid zeolite particles having an average alpha value of at least about 2 and an effective pore size of about 5 to 7 Angstroms; contacting at least a portion of light gas comprising $C_2$–$C_6$ olefins with particles in the secondary fluidized bed reaction stage under reaction severity conditions to obtain gasoline and/or distillate product; withdrawing from the secondary stage a portion of catalyst particles; and adding the zeolite catalyst particles to the primary fluidized bed reaction stage containing cracking catalyst. At least a portion of the intermediate product containing $C_3$–$C_4$ olefins can be added to the olefinic gas prior to contact with olefins conversion catalyst in the secondary stage. Additional fresh catalyst having a pore size of 5 to 7 Angstroms can be admixed with the catalysts added to the first stage.

It is not necessary for the practice of the present process to employ as feedstock for the olefins oligomerization reaction zone the off gas from the integrated FCC unit. It is contemplated that any feedstock containing lower molecular weight olefins can be used, regardless of the source.

It has also been found that crackable petroleum feedstocks can be more easily and efficiently converted to valuable hydrocarbon products by using an apparatus comprising a multi-stage continuous fluidized bed catalytic reactor system which comprises primary reactor means for contacting feedstock with a fluidized bed of solid catalyst particles under cracking conditions to provide liquid hydrocarbon product and reactive hydrocarbons; primary catalyst regenerator means operatively connected to receive a portion of catalyst from the primary reactor means for reactivating said catalyst portion; primary activated catalyst handling means to conduct at least a portion of reactivated catalyst from the primary regenerator means to the primary reactor means; means for recovering a reactive hydrocarbon stream; second reactor means for contacting at least a portion of the reactive hydrocarbons under high severity conversion conditions with a fluidized bed of activated solid catalyst particles to further convert reactive hydrocarbons to additional liquid hydrocarbon product and thereby depositing by-product coke onto the catalyst particles; and second catalyst regenerator means operatively connected to receive a portion of catalyst from the second reactor means for reactivating said catalyst portion; second activated catalyst handling means to conduct at least a portion of reactivated catalyst from the second regenerator means to the second reactor means; catalyst handling means operatively connected to conduct a portion of the catalyst from the secondary regenerator means to the primary reactor means for further petroleum feedstock conversion use.

FIG. 1 illustrates a process scheme for practicing the present invention. The flow of chemicals beginning with the heavy hydrocarbons feed at line 1 is schematically represented by solid lines. The flow of catalyst particles is represented by dotted lines. Chemical feedstock passes through conduit 1 and enters the first stage fluidized bed cracking reactor 10. The feed can be charged to the reactor with a diluent such as hydrocarbon or steam. Deactivated catalyst particles are withdrawn from fluidized bed reaction zone 10 via line 3 and passed to catalyst regeneration zone 40, where the particles having carbonaceous deposits thereon are oxidatively regenerated by known methods. The regenerated catalyst particles are then recycled via line 5 to reaction zone 10.

The coked catalyst from the secondary reaction zone 30 is sent via line 33 to second catalyst regenerator 50, where it is oxidatively regenerated and returned in activated form via line 35 to the second reaction zone 30. A portion of regenerated catalyst is sent via conduits 32 and 37 to first fluid bed reaction zone 10. Fresh medium pore zeolite catalyst can be admixed with the regenerated catalyst as by conduit 39. Also, fresh medium pore zeolite catalyst is added to olefins upgrading reaction zone 30 via conduit 20.

Cracked product from the FCC reaction zone 10 is withdrawn through conduit 2 and passed to a main fractionation tower 4 where the product is typically separated into a light gas stream, a middle stream, and a bottoms stream. The middle stream is recovered via conduit 12 and the bottoms stream is withdrawn through conduit 11. The light gas stream is withdrawn through conduit 6 and enters gas plant 8 for further separation. A middle fraction is drawn from the gas plant via conduit 14 and a heavy fraction is withdrawn via conduit 13. A stream comprising lower olefins is withdrawn via conduit 7 and enters high severity olefins oligomerization unit 30 where the stream contacts siliceous medium pore zeolite catalyst particles in a turbulent regime fluidized bed to form a hydrocarbon product rich in $C_5+$ hydrocarbons boiling in the gasoline and/or distillate range. The hydrocarbon product is removed from the olefins oligomerization zone 30 through conduit 9 for further processing.

Figure 2:
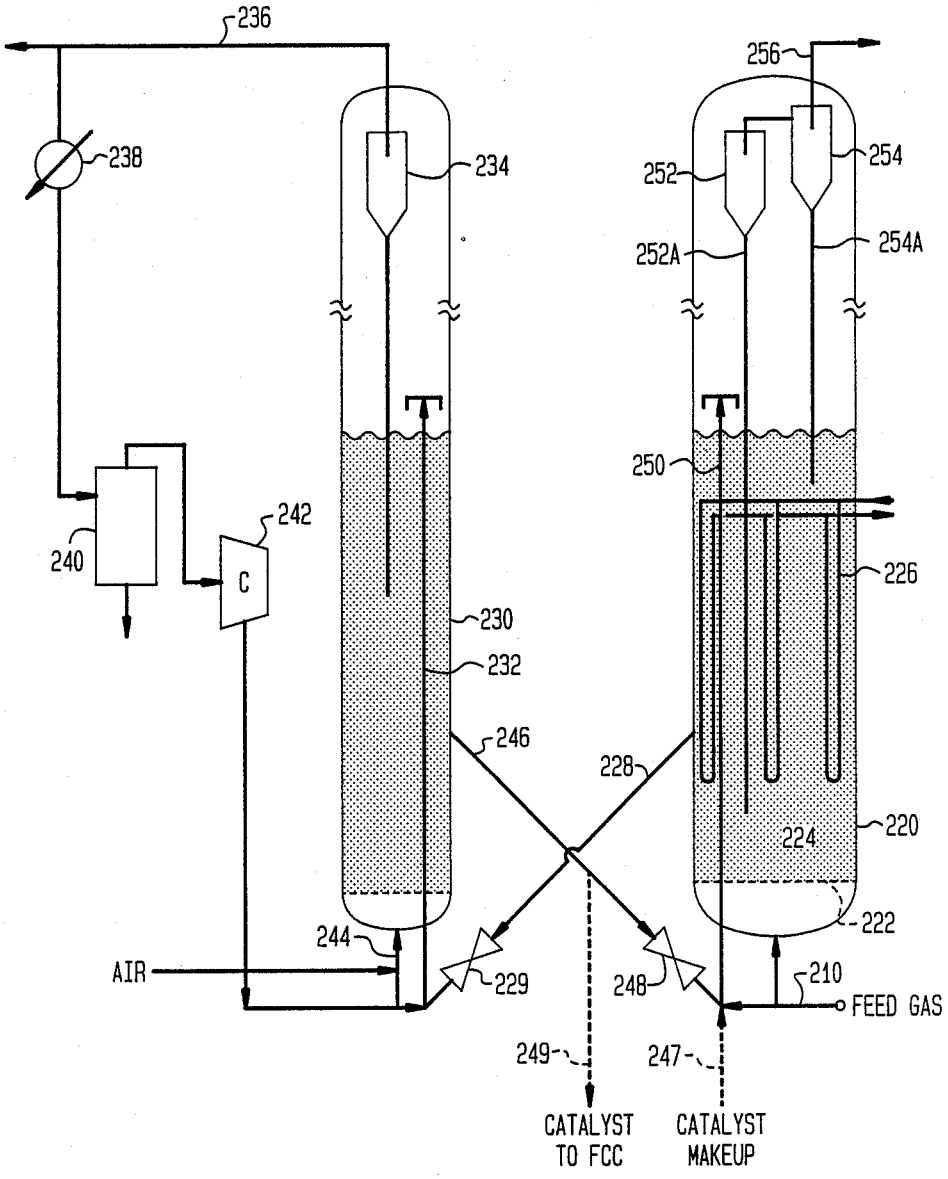
FIG. 2 is a schematic drawing of a secondary stage olefins oligomerization fluidized bed reactor system adapted for the present process.

Referring now to FIG. 2, feed gas rich in $C_2$–$C_3$ olefins passes under pressure through conduit 210, with the main flow being directed through the bottom inlet of reactor vessel 220 for distribution through grid plate 222 into the fluidization zone 224. Here the feed gas contacts the turbulent bed of finely divided catalyst particles. Reactor vessel 220 is shown provided with heat exchange tubes 226, which may be arranged as several separate heat exchange tube bundles so that temperature control can be separately exercised over different portions of the fluid catalyst bed. The bottoms of the tubes are spaced above feed distributor grid 222 sufficiently to be free of jet action by the charged feed through the small diameter holes in the grid. Alternatively, reaction heat can be partially or completely removed by using cold feed. Baffles may be added to control radial and axial mixing. Although depicted without baffles, the vertical reaction zone can contain open end tubes above the grid for maintaining hydraulic constraints, as disclosed in U.S. Pat. No. 4,251,484 (Daviduk and Haddad). Heat released from the reaction can be controlled by adjusting feed temperature in a known manner.

Catalyst outlet means 228 is provided for withdrawing catalyst from above bed 224 and passed for catalyst regeneration in vessel 230 via control valve 229. The partially deactivated catalyst is oxididatively regenerated by controlled contact with air or other regeneration gas at elevated temperature in a fluidized regeneration zone to remove carbonaceous deposits and restore acid activity. The catalyst particles are entrained in a lift gas and transported via riser tube 232 to a top portion of vessel 230. Air is distributed at the bottom of the bed to effect fluidization, with oxidation byproducts, being carried out of the regeneration zone through cyclone separator 234, which returns any entrained solids to the bed. Flue gas is withdrawn via top conduit 236 for disposal; however, a portion of the flue gas may be recirculated via heat exchanger 238, separator 240, and compressor 242 for return to the vessel with fresh oxidation gas via line 244 and as lift gas for the catalyst in riser 232.

Regenerated catalyst is passed to the main reactor 220 through conduit 246 provided with flow control valve 248. Equilibrium catalyst is withdrawn via conduit 249 and passed to a fluidized bed catalytic cracking unit (not shown). Fresh catalyst having a high alpha value can be added to the fluidized bed 224 as by conduit 247. A series of sequentially connected cyclone separators 252, 254 are provided with diplegs 252A, 254A to return any entrained catalyst fines to the lower bed. These separators are positioned in an upper portion of the reactor vessel comprising dispersed catalyst phase 224. Filters, such as sintered metal plate filters, can be used alone or conjunction with cyclones.

The product effluent separated from catalyst particles in the cyclone separating system is then withdrawn from the reactor vessel 220 through top gas outlet means 256. The recovered hydrocarbon product comprising $C_5+$ olefins and/or aromatics, paraffins and naphthenes is thereafter processed as required according to the present invention.

Figure 3:
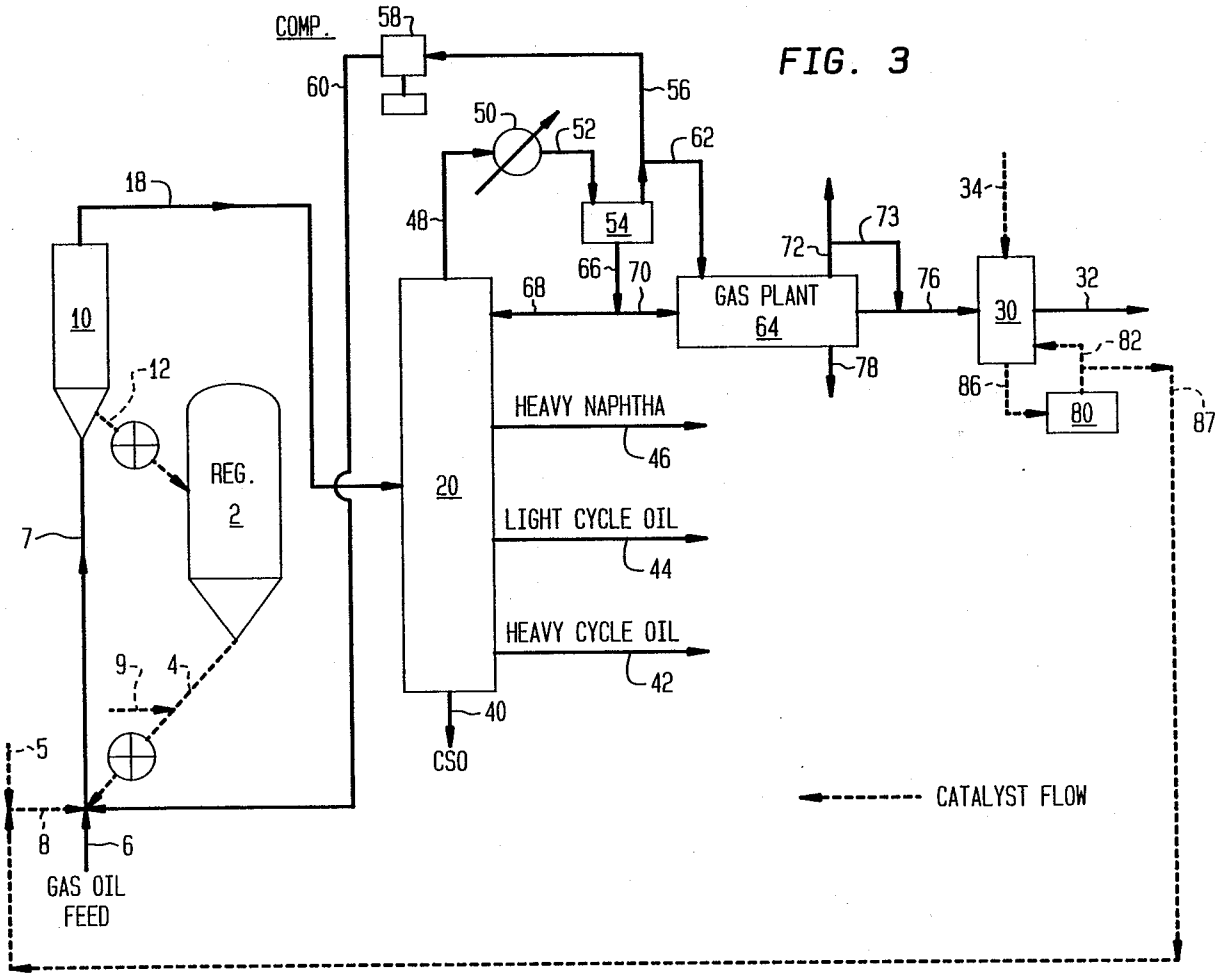
FIG. 3 is a process flow diagram of an integrated FCC-olefins oligomerization unit.

Referring to FIG. 3, a process for preparing high octane gasoline from heavy crackable hydrocarbon feedstocks is illustrated. A heavy hydrocarbonaceous feedstock enters riser reactor 7 via conduit 6 where it contacts a fluidized FCC cracking catalyst under suitable conditions to yield cracked products. Catalyst and products are separated in reactor vessel 10. The cracked products are withdrawn through conduit 18 and conveyed to fractionation tower 20.

In fractionation zone 20, the introduced products are separated. A clarified slurry oil is withdrawn from a bottom portion of tower 20 by conduit 40. A heavy cycle oil is withdrawn by conduit 42, a light cycle oil is withdrawn by conduit 44 and a heavy naphtha fraction is withdrawn by conduit 46. Material lower boiling than the heavy naphtha is withdrawn from the tower as by conduit 48, cooled by cooler 50 to a temperature of about 100° F. before passing by conduit 52 to knockout drum 54. In drum 54 a separation is made between vaporous and liquid materials. Vaporous material comprising $C_5$ and lower boiling gases are withdrawn by conduit 56, passed to compressor 58 and recycled by conduit 60 to the lower portion of riser reactor 7. A portion of the vaporous $C_5$ and lower boiling material is passed by conduit 62 to a gas plant 64. Liquid material recovered in drum 54 is withdrawn by conduit 66 and recycled in part as reflux by conduit 68 to tower 20. The remaining portion of the recovered liquid is passed by conduit 70 to gas plant 64.

In gas plant 64 a separation is made to recover gases comprising $C_3$- materials as by conduit 76, a $C_3$–$C_4$ light olefin rich stream as by conduit 72 and a light gasoline stream by conduit 78. The $C_3$- stream enters oligomerization zone 30 comprising a dense fluidized catalyst bed conversion zone where the stream contacts under oligomerization conditions a crystalline siliceous medium pore zeolite catalyst. Valuable hydrocarbon product comprising gasoline and/or distillate is withdrawn from oligomerization reactor 30 as by conduit 32. Part or all of $C_3$–$C_4$ olefinic stream 72 may be added to the $C_3$- stream 76 via conduit 73 to increase gasoline production in reactor 30.

Catalyst transfer in FIG. 3 is represented by dotted lines. Spent cracking catalyst from riser reactor 7 having an average alpha value of about 10 or less is separated and stripped in vessel 10 and withdrawn by conduit 12 and enters regeneration unit 2 where the catalyst is oxidatively regenerated. The regenerated catalyst is recycled to rise reactor 7 via conduit 4. Fresh cracking catalyst can be added as by conduit 9 to the generated catalyst to maintain optimum catalyst activity for the cracking process.

Partially deactivated catalyst is withdrawn from the oligomerization reactor 30 via conduit 86 and passed to regeneration zone 80. After regeneration, a large portion of regenerated catalyst is recycled to oligomerization reactor 30 via conduit 82 and a small portion of regenerated catalyst is conducted to riser reactor 7 via conduits 87 and 8. Fresh acidic medium pore zeolite particles can be added via conduit 5.

Preferably, the medium pore zeolite catalyst in activated form is added as fresh catalyst to the olefins oligomerization reaction by conduit 34 in an amount of about 0.1 to 3 percent by weight of the total fluidized catalyst inventory in the oligomerization reactor. To maintain equilibrium catalyst activity, zeolite catalyst is withdrawn from the oligomerization zone regenerator 80 and added to the FCC reactor in an amount of about 0.1 to 3 percent by weight based on the total fluidized catalyst inventory in the oligomerization reactor. The medium pore zeolite catalyst is more preferably ZSM-5.

The catalyst inventory in the FCC reactor preferably comprises zeolite Y which is impregnated with one or more rare earth elements (REY). This large pore cracking catalyst is combined in the FCC reactor with the ZSM-5 withdrawn from the oligomerization reactor catalyst regeneration zone to obtain a mixed FCC cracking catalyst which provides a gasoline yield having improved octane number and an increased yield of lower molecular weight olefins which can be upgraded in the oligomerization reactor or an alkylation unit (not shown).

Catalyst inventory in the fluidized catalytic cracking unit is controlled so that the ratio of cracking catalyst to the added zeolite oligomerization catalyst is about 5:1 to about 20:1. In a preferred example the zeolite oligomerization catalyst has an apparent acid cracking value of about 2 to 30 when it is withdrawn from the fluidized bed olefins oligomerization unit for recycle to the FCC unit. The fresh medium pore catalyst for the olefins oligomerization unit and the FCC unit has an apparent acid cracking value about 80 and above.

In a preferred example, the total amount of fluidized catalyst in the FCC reactor is about ten times as much as the amount of fluidized catalyst in the oligomerization reactor. To maintain equilibrium catalyst activity in the FCC reactor, fresh Y zeolite catalyst particles are added in an amount of about 1 to 2 percent by weight based on total amount of catalyst present in the FCC reactor. Spent cracking catalyst is then withdrawn for subsequent disposal from the FCC reactor in an amount substantially equivalent to the combination of fresh REY zeolite catalyst and partially deactivated ZSM-5 catalyst which is added to the reactor.

In a typical example of the present process, an FCC reactor is operated in conjunction with an olefins oligomerization reactor (vide supra). The catalyst flow rates per day are adjusted so that about 1 to 3 percent by weight of fresh large pore zeolite cracking catalyst based on total amount of catalyst present in the FCC reactor is added to the FCC reactor; about 0.5 to 2.0 percent by weight fresh zeolite ZSM-5 catalyst based on total amount of catalyst present in the olefins oligomerization reactor is added to the olefins oligomerization reactor; and about 0.5 to 2.0 percent by weight of zeolite ZSM-5 catalyst based on total amount of catalyst present in the olefins oligomerization reactor is withdrawn from the olefins oligomerization reactor, regenerated, and added to the catalyst inventory of the FCC reactor. The gasoline range hydrocarbons obtained from the FCC reactor have an increased octane rating (using the R+M/2 method, where R=research octane number and M=motor octane number) of 0.7. The gasoline range hydrocarbons obtained from the olefins oligomerization reactor typically have octane rating increased by about 0.2 to 1. In each case, comparison was made with gasoline range hydrocarbons from an integrated FCC-olefins oligomerization system which did not have catalyst handling means operatively connected to conduct a portion of partially deactivated or equilibrium catalyst from the olefins oligomerization stage to the FCC stage.

While the invention has been described by reference to certain embodiments, there is no intent to limit the inventive concept except as set forth in the following claims:

1. A continuous multi-stage process for increasing the octane and the yield of liquid hydrocarbons from an integrated fluidized catalytic cracking unit and olefins oligomerization reaction zone comprising:

contacting crackable petroleum feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_6$ olefins, intermediate hydrocarbons in the gasoline and distillate range, and cracked bottoms;

regenerating primary stage zeolite cracking catalyst in a primary stage regeneration zone and returning at least a portion of regenerated zeolite cracking catalyst to the primary reaction stage;

separating the gas containing $C_2$–$C_6$ olefins;

reacting at least a portion of the gas in a secondary fluidized bed reactor stage in contact with acid zeolite catalyst particles consisting essentially of medium pore shape selective zeolite under reaction conditions to effectively convert a portion of the $C_2$–$C_6$ olefins to hydrocarbons boiling in the gasoline or distillate range;

reactivating secondary stage medium pore zeolite catalyst in a separate reactivation zone and returning at least a portion of reactivated medium pore zeolite catalyst to the secondary reaction stage;

withdrawing a portion of catalyst from the secondary fluidized bed reactor stage; and passing said withdrawn catalyst portion to the primary fluidized bed reaction stage for contact with the petroleum feedstock.

2. A process according to claim 1 wherein catalyst withdrawn from the second fluidized bed reaction stage is in partially deactivated form and has an average alpha value of about 2 to 30.

3. A process according to claim 1 wherein fresh catalyst having an average alpha value of at least about 80 is added to the second fluidized bed reaction stage.

4. The process of claim 1 wherein the medium pore zeolite comprises ZSM-5 and a silica-alumina matrix.

5. A continuous multi-stage process for producing liquid hydrocarbons from crackable petroleum feedstock comprising:

contacting the feedstock in a primary fluidized catalyst reaction stage with a mixed catalyst system which comprises finely divided particles of a first large pore cracking catalyst component and finely divided particles of a second medium pore siliceous zeolite catalyst component under cracking conditions to obtain a product comprising intermediate gasoline and distillate range hydrocarbons, and a gas rich in olefins;

separating the olefinic gas and contacting said olefins with particulate catalyst solids consisting essentially of medium pore siliceous zeolite catalyst in a secondary fluidized bed reaction stage under reaction severity conditions effective to upgrade said olefins to mostly $C_5$+ hydrocarbons, thereby depositing carbonaceous material onto the particulate zeolite catalyst to obtain an equilibrium catalyst;

withdrawing a portion of partially deactivated equilibrium particulate zeolite catalyst from the secondary reaction stage and regenerating the equilibrium catalyst; and adding a portion of the regenerated zeolite catalyst to the primary fluidized reaction stage for conversion of crackable petroleum feedstock, whereby catalyst makeup of a primary stage fluidized catalytic cracking unit and a secondary stage olefins conversion unit is balanced; wherein catalyst flow rates per day are adjusted so that about 1 to 3 percent by weight of fresh large pore cracking catalyst based on total amount of catalyst present in the primary fluidized bed reaction stage is added to the primary reaction stage; about 0.5 to 2.0 percent by weight fresh medium pore zeolite catalyst based on total amount of catalyst present in the secondary fluidized bed reaction stage is added to the secondary reaction stage; and about 0.5–2.0 percent by weight of regenerated zeolite catalyst based on total amount of catalyst present in the secondary reaction stage is withdrawn from the secondary reaction stage and added to the primary fluidized bed reaction stage to increase octane by 0.2–1 Research Octane Number.

6. A process according to claim 5 wherein catalyst in the secondary fluidized bed reaction stage has an average alpha value of at least about 2 and total catalyst in the primary fluidized bed reaction stage has an average alpha value of about 10 or less.

7. A process according to claim 5 wherein fresh medium pore siliceous zeolite catalyst is admixed with the regenerated catalyst prior to addition of catalyst to the primary fluidized reaction stage.

8. A process for integrating the catalyst inventory of a fluidized catalytic cracking unit and a fluidized bed reaction zone for the conversion of olefins to gasoline or distillate, the process comprising;

maintaining a primary fluidized bed reaction stage containing cracking catalyst comprising a mixture of crystalline aluminosilicate particles having a pore size greater than 8 Angstroms and crystalline medium pore zeolite particles having a pore size of about 5 to 7 Angstroms;

converting a feedstock comprising a petroleum fraction boiling above about 250° C. by passing the feedstock upwardly through the primary stage fluidized bed in contact with the mixture of cracking catalyst particles under cracking conditions of temperature and pressure to obtain a product stream comprising cracked hydrocarbons;

reactivating primary stage zeolite cracking catalyst in a primary stage reactivation zone and returning at least a portion of reactivated zeolite cracking catalyst to the primary reaction stage;

separating the product stream to produce olefinic gas, intermediate products containing $C_3$–$C_4$ olefins, gasoline and distillate range hydrocarbons, and a bottoms fraction;

maintaining a secondary fluidized bed reaction stage containing finely divided olefins conversion catalyst consisting essentially of crystalline medium pore zeolite particles having an average alpha value of at least about 2 and a pore size of about 5 to 7 Angstroms;

contacting at least a portion of gas comprising olefins with said medium pore zeolite particles in the secondary fluidized bed reaction stage under reaction severity conditions to obtain gasoline or distillate product;

reactivating secondary stage medium pore zeolite catalyst in a secondary stage reactivation zone and returning at least a portion of reactivated medium pore zeolite catalyst to the secondary reaction stage;

withdrawing from the secondary stage a portion of catalyst particles; and adding the zeolite catalyst particles to the primary fluidized bed reaction stage containing cracking catalyst.

9. A process according to claim 8 wherein the catalyst flow rates per day are adjusted so that about 1 to 3 percent by weight of fresh cracking catalyst based on total amount of catalyst present in the primary fluidized bed reaction stage is added to the primary reaction stage; about 0.5 to 2.0 percent by weight fresh zeolite catalyst based on total amount of catalyst present in the secondary fluidized bed reaction stage is added to the secondary reaction stage; and about 0.5–2.0 percent by weight of partially deactivated zeolite catalyst based on total amount of catalyst present in the secondary reaction stage is withdrawn from the secondary reaction stage and added to the primary fluidized bed reaction stage to increase octane by 0.2–1 Research Octane Number (RON) (based 92 Research Octane Number).

10. A process according to claim 8 wherein the Reaction Severity Index (R.I.) is about 0.2:1 to about 5:1, based on the ratio of propane to propene in the product obtained from the secondary fluidized bed reaction stage.

11. A process according to claim 8 wherein at least a portion of the intermediate product containing $C_3$–$C_4$ olefins is added to the olefinic gas prior to contact with olefins conversion catalyst in the secondary fluidized bed reaction stage.

12. A process according to claim 8 wherein said medium pore zeolite comprises ZSM-5.

* * * * *